US011562850B2

(12) United States Patent
Kang et al.

(10) Patent No.: US 11,562,850 B2
(45) Date of Patent: Jan. 24, 2023

(54) COIL COMPONENT

(71) Applicant: SAMSUNG ELECTRO-MECHANICS CO., LTD., Suwon-si (KR)

(72) Inventors: Byung Soo Kang, Suwon-si (KR); Seung Mo Lim, Suwon-si (KR); Seung Min Lee, Suwon-si (KR); Byeong Cheol Moon, Suwon-si (KR); Yong Hui Li, Suwon-si (KR); Ju Hwan Yang, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 447 days.

(21) Appl. No.: 16/874,892

(22) Filed: May 15, 2020

(65) Prior Publication Data

US 2021/0183564 A1 Jun. 17, 2021

(30) Foreign Application Priority Data

Dec. 12, 2019 (KR) ..... 10-2019-0165359

(51) Int. Cl.
*H01F 27/29* (2006.01)
*H01F 27/24* (2006.01)
(Continued)

(52) U.S. Cl.
CPC ..... *H01F 27/29* (2013.01); *H01F 27/24* (2013.01); *H01F 27/2804* (2013.01);
(Continued)

(58) Field of Classification Search
CPC ..... H01F 27/29; H01F 27/24; H01F 27/2804; H01F 27/32; H01F 41/041; H01F 41/12; H01F 2027/2809
(Continued)

(56) References Cited

U.S. PATENT DOCUMENTS 7,911,311 B2 * 3/2011 Matsuta ..... H01F 17/0013 336/200
2005/0052267 A1 * 3/2005 Singu ..... H01F 27/292 336/83
(Continued)

FOREIGN PATENT DOCUMENTS

KR 10-2015-0019730 A 2/2015
KR 10-1548862 B1 8/2015
(Continued)

OTHER PUBLICATIONS

Korean Office Action dated Oct. 21, 2020 issued in Korean Patent Application No. 10-2019-0165359 (with English translation).

*Primary Examiner* — Suresh Memula
(74) *Attorney, Agent, or Firm* — Morgan, Lewis & Bockius LLP

(57) ABSTRACT

A coil component includes a body, a support substrate embedded in the body, a coil portion including first and second lead-out portions disposed on one surface of a support substrate and spaced apart from each other, slit portions formed along edge portions between both end surfaces of the body, opposing each other, and a first surface of the body, respectively, and exposing the first and second lead-out portions to internal surfaces of the slit portions, respectively, plating prevention portions embedded in the first and second lead-out portions, respectively, and having first surfaces exposed to the internal surfaces of the slit portions, respectively, and first and second external electrodes disposed on the first surface of the body, spaced apart from each other, extending to the internal surfaces of the slit portions, respectively, and connected to the first and second lead-out portions, respectively.

20 Claims, 7 Drawing Sheets

(51) Int. Cl.
*H01F 27/28* (2006.01)
*H01F 27/32* (2006.01)
*H01F 41/04* (2006.01)
*H01F 41/12* (2006.01)

(52) U.S. Cl.
CPC ..... *H01F 27/32* (2013.01); *H01F 41/041* (2013.01); *H01F 41/12* (2013.01); *H01F 2027/2809* (2013.01)

(58) Field of Classification Search
USPC ..... 336/192
See application file for complete search history.

(56) References Cited

U.S. PATENT DOCUMENTS

2013/0314189 A1* 11/2013 Okumura ..... H01F 17/04 336/192
2014/0009254 A1* 1/2014 Ohkubo ..... H01F 17/0033 336/192
2014/0043129 A1* 2/2014 Wi ..... H01F 41/042 29/602.1
2014/0139307 A1* 5/2014 Kido ..... H01F 27/2804 29/609
2015/0028983 A1* 1/2015 Ryu ..... H01F 1/15308 29/846
2015/0048915 A1* 2/2015 Yoon ..... H01F 17/0013 336/192
2015/0091685 A1* 4/2015 Kitajima ..... H01F 27/306 29/602.1
2015/0123757 A1* 5/2015 Choi ..... H01F 41/046 29/609
2015/0155093 A1* 6/2015 Kim ..... H01F 41/046 156/314
2015/0255206 A1* 9/2015 Han ..... H01F 41/041 336/192
2015/0270053 A1* 9/2015 Cha ..... H01F 17/04 336/192
2016/0086714 A1* 3/2016 Moon ..... H01F 27/292 336/200
2016/0086720 A1* 3/2016 Jeong ..... H01F 27/292 336/200
2016/0104563 A1* 4/2016 Jeong ..... H01F 17/0013 336/200
2016/0126004 A1* 5/2016 Yang ..... H01F 27/292 336/90
2016/0172102 A1* 6/2016 Jeong ..... H01F 27/255 29/605
2016/0172103 A1* 6/2016 Jeong ..... H01F 17/04 29/605
2016/0189840 A1* 6/2016 Ahn ..... H01F 17/04 29/602.1
2016/0189849 A1* 6/2016 Lee ..... H01F 41/10 29/602.1
2016/0217920 A1 7/2016 Choi et al.
2019/0148053 A1* 5/2019 Kaneko ..... H01F 5/04 336/192
2020/0035404 A1 1/2020 Lim et al.
2022/0139606 A1* 5/2022 Lee ..... H01F 27/323 336/192

FOREIGN PATENT DOCUMENTS

KR 1607026 B1 * 3/2016 ..... F16L 9/00
KR 10-2016-0092543 A 8/2016
KR 10-2052834 B1 12/2019

* cited by examiner

COIL COMPONENT

CROSS-REFERENCE TO RELATED APPLICATION(S)

The present application claims the benefit of priority to Korean Patent Application No. 10-2019-0165359, filed on Dec. 12, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a representative passive electronic component used in electronic devices, together with a resistor and a capacitor.

As an electronic device has been designed to have high performance and a reduced size, the number of coil components used in an electronic device has been increased, and the sizes of coil components have been reduced.

Generally, an external electrode of a coil component may be disposed on each of two surfaces of a body opposing each other. In this case, an overall length or an overall width of the coil component may increase due to a thickness of the external electrode. Also, when a coil component is mounted on a mounting substrate, an external electrode of a coil component may be in contact with the other component disposed adjacently to a mounting substrate such that electrical shorts may occur.

SUMMARY

An aspect of the present disclosure is to provide a coil component which may have a reduced thickness and size.

Another aspect of the present disclosure is to provide a coil component which may easily form a lower surface electrode structure.

According to an aspect of the present disclosure, a coil component includes a body having a first surface and a second surface opposing each other, and a plurality of walls connecting the first surface to the second surface, the plurality of walls including both end surfaces opposing each other; a support substrate embedded in the body; a coil portion including first and second lead-out portions disposed on one surface of the support substrate facing the first surface of the body and spaced apart from each other; slit portions formed along edge portions between the both end surfaces and the first surface of the body, respectively, and exposing the first and second lead-out portions to internal surfaces of the slit portions, respectively, plating prevention portions embedded in the first and second lead-out portions, respectively, and having first surfaces exposed to the internal surfaces of the slit portions, respectively; and first and second external electrodes disposed on the first surface of the body, spaced apart from each other, extending to the internal surfaces of the slit portions, respectively, and connected to the first and second lead-out portions, respectively.

According to an aspect of the present disclosure, a coil component includes a body having a first surface and a second surface opposing each other in a thickness direction of the body, and a plurality of walls connecting the first surface to the second surface, the plurality of walls including both end surfaces opposing each other in a length direction of the body; a support substrate embedded in the body; a coil portion including first and second lead-out portions disposed on one surface of the support substrate facing the first surface of the body in the thickness direction, the first and second lead-out portions being spaced apart from each other and exposed to the both end surfaces in the length direction; first and second external electrodes disposed on the first surface of the body, spaced apart from each other, and connected to the first and second lead-out portions, respectively; and first and second plating prevention portions embedded in the first and second lead-out portions, respectively. The body includes first and second slit portions along edge portions between the both end surfaces and the first surface of the body, respectively. The first and second plating prevention portions extend along the first and second slit portions, respectively, in the length direction, and the first and second external electrodes extend along the first and second slit portions, respectively, in the thickness direction. The first and second external electrodes at least partially overlap, and are in contact with, the first and second plating prevention portions, respectively, in the thickness direction.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
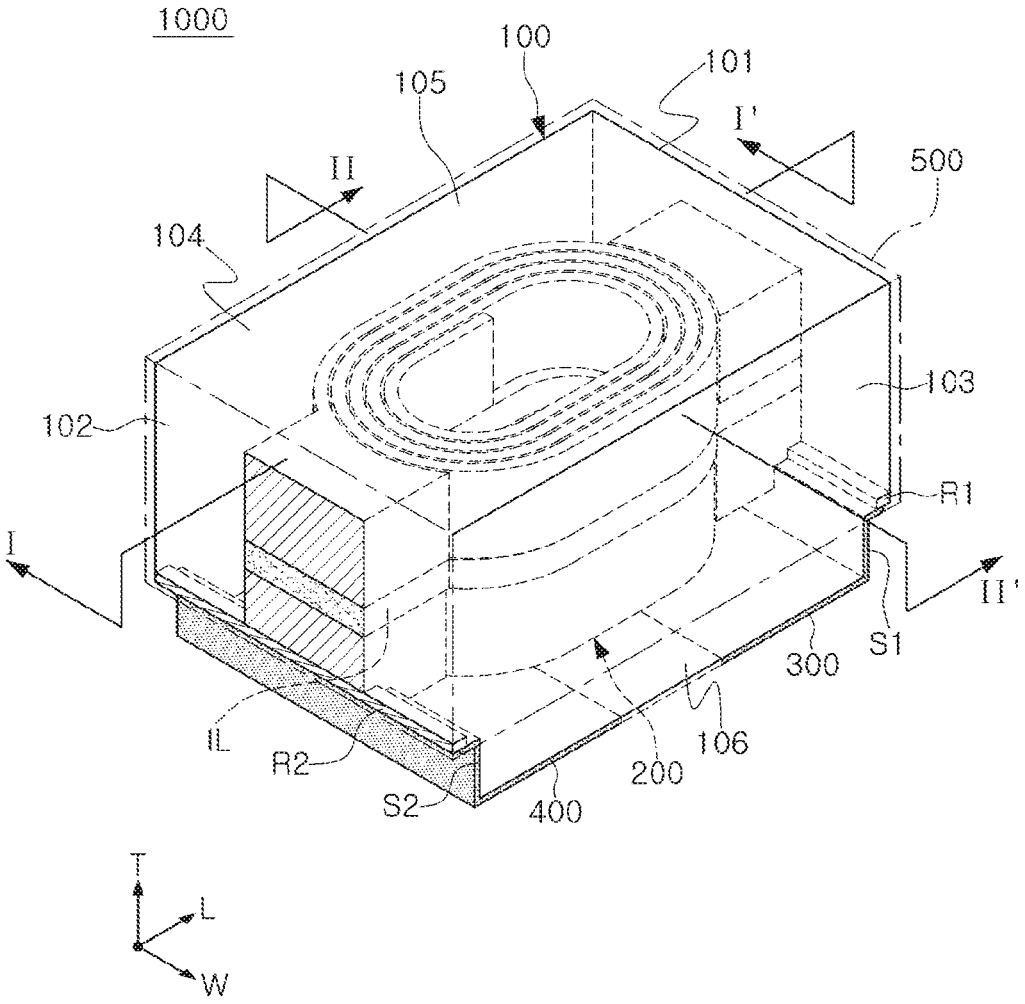
FIG. 1 is a diagram illustrating a coil component according to a first embodiment of the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

In the drawings, an L direction is a first direction or a length direction, a W direction is a second direction or a width direction, a T direction is a third direction or a thickness direction.

In the descriptions described with reference to the accompanied drawings, the same elements or elements corresponding to each other will be described using the same reference numerals, and overlapped descriptions will not be repeated.

In electronic devices, various types of electronic components may be used, and various types of coil components may be used between the electronic components to remove noise, or for other purposes.

In other words, in electronic devices, a coil component may be used as a power inductor, a high frequency inductor, a general bead, a high frequency bead, a common mode filter, and the like.

First Embodiment

Figure 2:
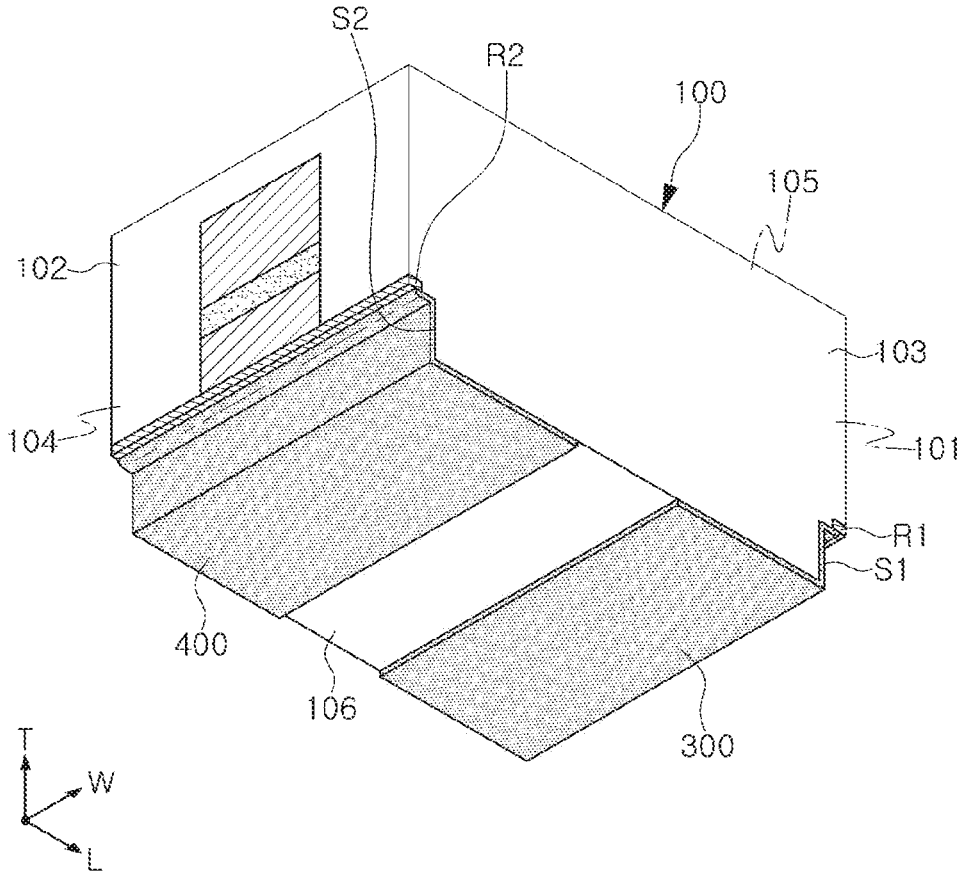
FIG. 2 is a diagram illustrating the coil component illustrated in FIG. 1 from which some elements are omitted, viewed from a lower portion.
Figure 3:
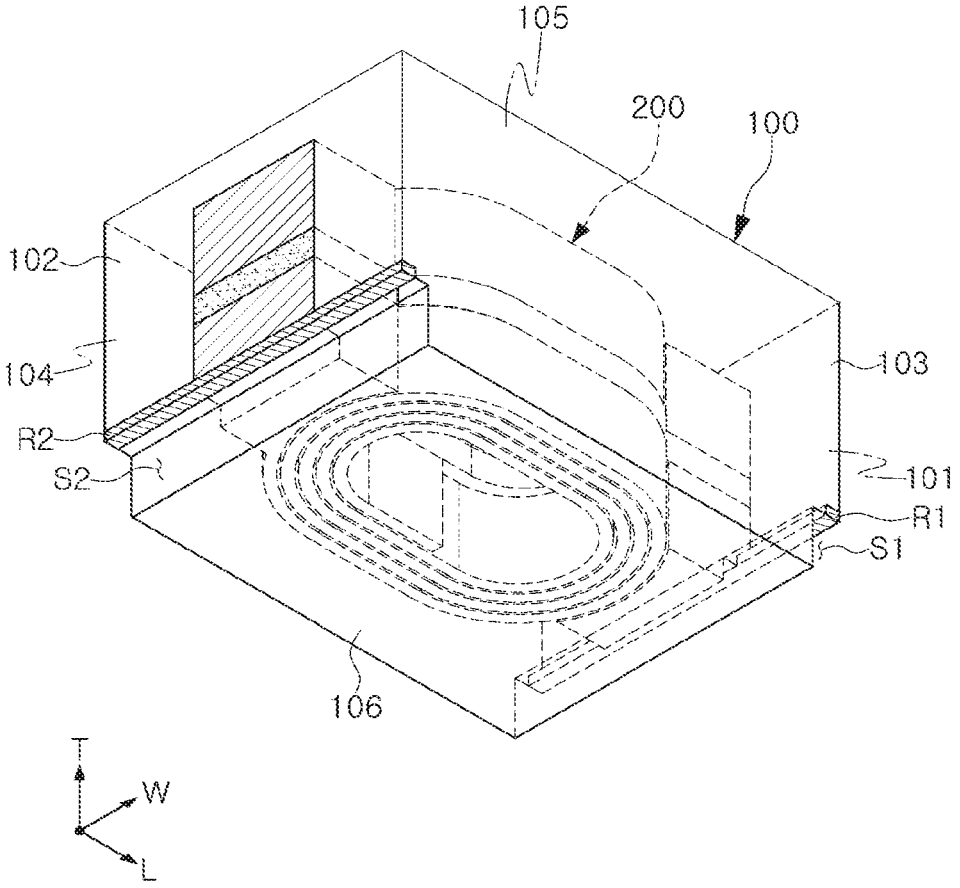
FIG. 3 is a diagram illustrating the coil component illustrated in FIG. 2 from which some elements are omitted.
Figure 4:
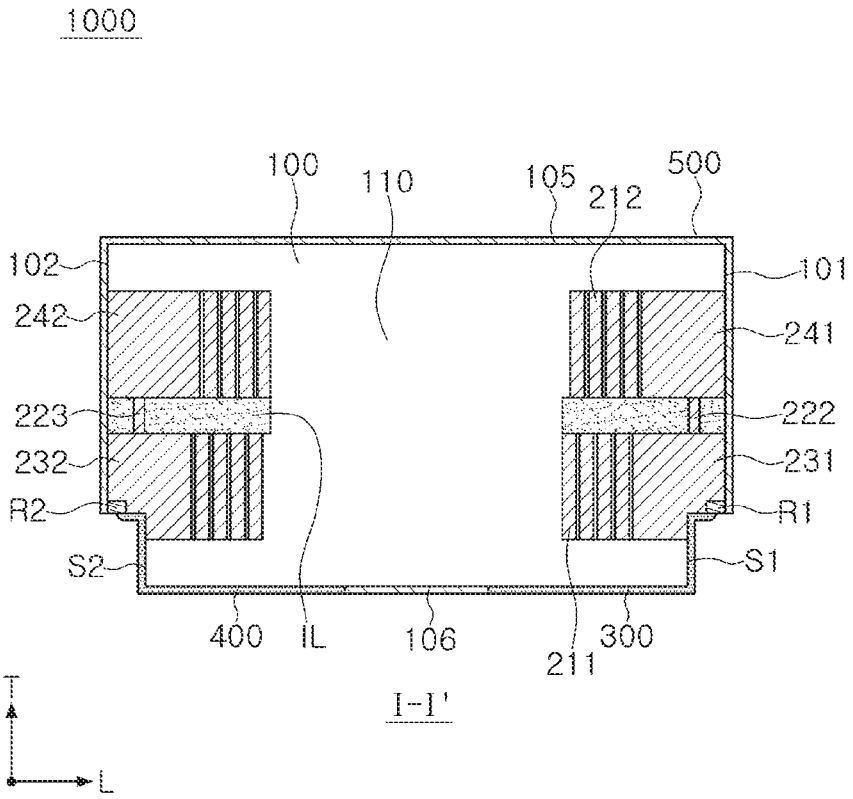
FIG. 4 is a cross-sectional diagram taken along line I-I' in FIG. 1.
Figure 5:
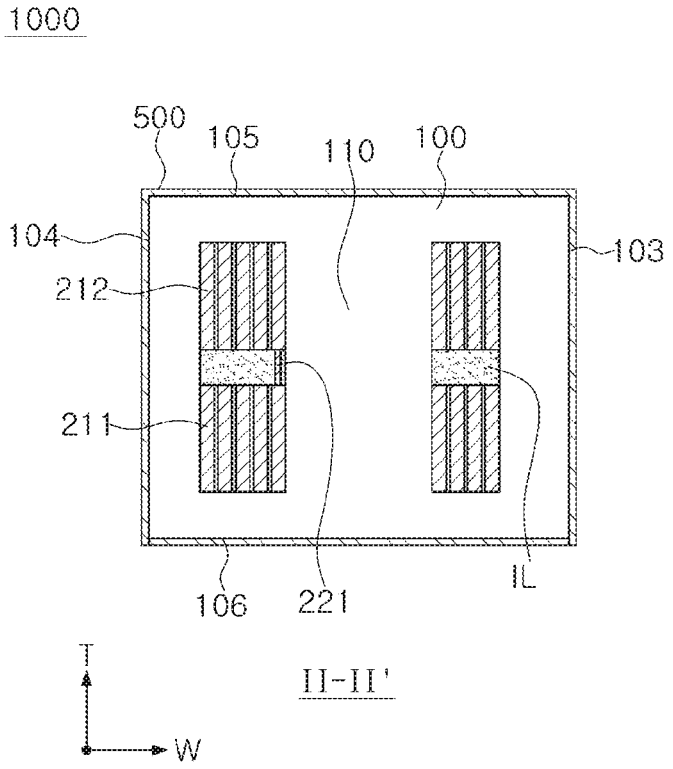
FIG. 5 is a cross-sectional diagram taken along line II-II' in FIG. 1.
Figure 6:
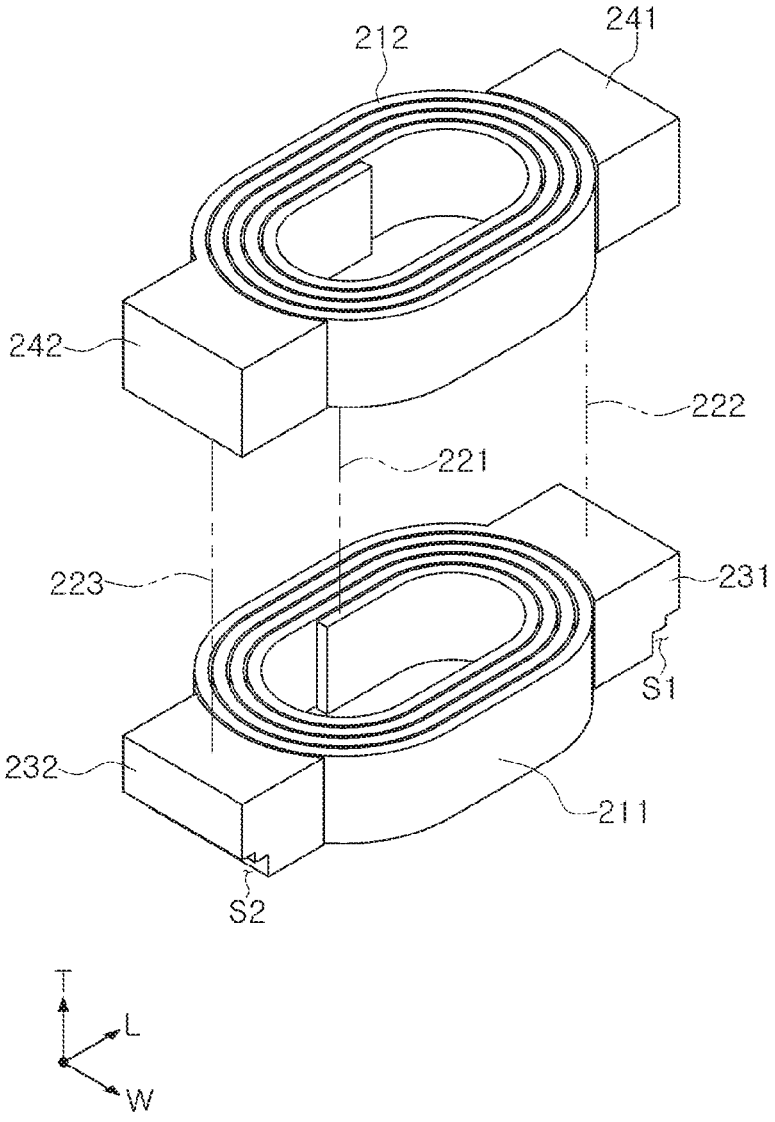
FIG. 6 is an exploded diagram illustrating a coil component.

FIG. 1 is a diagram illustrating a coil component according to a first embodiment. FIG. 2 is a diagram illustrating the coil component illustrated in FIG. 1 from which some elements are omitted, viewed from a lower portion. FIG. 3 is a diagram illustrating the coil component illustrated in FIG. 2 from which some elements are omitted. FIG. 4 is a cross-sectional diagram taken along line I-I' in FIG. 1. FIG. 5 is a cross-sectional diagram taken along line II-II' in FIG. 1. FIG. 6 is an exploded diagram illustrating a coil component. FIG. 2 illustrates an example in which the coil component of the first embodiment illustrated in FIG. 1 from which a surface insulating layer is removed, viewed from a lower portion, for ease of description. FIG. 3 illustrates the coil component illustrated in FIG. 2 from which an external electrode is removed.

Referring to FIGS. 1 to 6, a coil component 1000 in the first embodiment may include a body 100, a support substrate IL, slit portions S1 and S2, a coil portion 200, external electrodes 300 and 400, and plating prevention portions R1 and R2, and may further include a surface insulating layer 500.

The body 100 may form an exterior of the coil component 1000 in the embodiment, and the support substrate IL and the coil portion 200 may be embedded in the body 100.

The body 100 may have a hexahedral shape.

As illustrated in FIGS. 1 to 5, the body 100 may include a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may be walls of the body 100 connecting the fifth surface 105 and the sixth surface 106 of the body 100 to each other. In the description below, "both end surfaces of the body" may refer to the first surface 101 and the second surface 102 of the body 100, and "both side surfaces of the body" may refer to the third surface 103 and the fourth surface 104 of the body 100. Also, one surface of the body 100 may refer to the sixth surface 106 of the body 100, and the other surface of the body 100 may refer to the fifth surface 105 of the body 100.

The body 100 may be formed such that the coil component 1000 in which the external electrodes 300 and 400 are formed may have a length of 2.0 mm, a width of 1.2 mm, and a thickness of 0.65 mm, for example, but an example embodiment thereof is not limited thereto.

The body 100 may include a magnetic material and resin. For example, the body 100 may be formed by layering one or more magnetic composite sheets in which a magnetic material is dispersed in resin. Alternatively, the body 100 may have a structure different from the structure in which a magnetic material is dispersed in resin. For example, the body 100 may be formed of a magnetic material such as ferrite.

The magnetic material may be ferrite or a magnetic metal powder.

The ferrite powder may include, for example, one or more materials of a spinel ferrite such as an Mg—Zn ferrite, an Mn—Zn ferrite, an Mn—Mg ferrite, a Cu—Zn ferrite, an Mg—Mn—Sr ferrite, an Ni—Zn ferrite, and the like, a hexagonal ferrite such as a Ba—Zn ferrite, a Ba—Mg ferrite, a Ba—Ni ferrite, a Ba—Co ferrite, a Ba—Ni—Co ferrite, and the like, a garnet ferrite such as a Y ferrite, and a Li ferrite.

The magnetic metal powder may include one or more selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be one or more of a pure iron powder, a Fe—Si alloy powder, a Fe—Si—Al alloy powder, a Fe—Ni alloy powder, a Fe—Ni—Mo alloy powder, Fe—Ni—Mo—Cu alloy powder, a Fe—Co alloy powder, a Fe—Ni—Co alloy powder, a Fe—Cr alloy powder, a Fe—Cr—Si alloy powder, a Fe—Si—Cu—Nb alloy powder, a Fe—Ni—Cr alloy powder, and a Fe—Cr—Al alloy powder.

The magnetic metal powder may be amorphous or crystalline. For example, the magnetic metal powder may be a Fe—Si—B—Cr amorphous alloy powder, but an example embodiment of the magnetic metal powder is not limited thereto.

Each particle of the ferrite and the magnetic metal powder may have an average diameter of 0.1 μm to 30 μm, but an example of the average diameter is not limited thereto.

The body 100 may include two or more types of magnetic materials dispersed in resin. The notion that types of the magnetic materials are different may indicate that one of an average diameter, a composition, crystallinity, and a form of a magnetic material disposed in a resin is different from those of the other magnetic material(s).

The resin may include one of epoxy, polyimide, a liquid crystal polymer, or mixtures thereof, but the example of the resin is not limited thereto.

The body 100 may include a core 110 penetrating the coil portion 200. The core 110 may be formed by filling a through-hole of the coil portion 200 with a magnetic composite sheet, but an example embodiment thereof is not limited thereto.

The support substrate IL may be embedded in the body 100. The support substrate IL may support the coil portion 200.

The support substrate IL may be formed of an insulating material including a thermosetting insulating resin such as an epoxy resin, a thermoplastic insulating resin such as a polyimide, or a photosensitive insulating resin, or may be formed of an insulating material in which a reinforcing material such as glass fiber or an inorganic filler is impregnated in the above-described insulating resin. For example, the support substrate IL may be formed of a material such as prepreg, Ajinomoto Build-up Film (ABF), FR-4, a bismaleimide triazine (BT) resin, a photoimageable dielectric (PID), and the like, but an example of the material is not limited thereto.

As an inorganic filler, one or more materials selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the support substrate IL is formed of an insulating material including a reinforcing material, the support substrate IL may provide improved stiffness. When the support substrate IL is formed of an insulating material which does not include a glass fiber, the support substrate IL may be desirable in reducing an overall thickness of the coil portion 200. When the support substrate IL is formed of an insulating material including a photosensitive insulating resin, the number of processes for forming the coil portion 200 may be reduced, which may be advantageous in reducing production costs, and a fine via may be formed.

The slit portions S1 and S2 may be formed along edge portions between the first and second surfaces 101 and 102 of the body 100 and the sixth surface of the body 100. The first slit portion S1 may be formed along an edge portion between the first surface 101 of the body 100 and the sixth surface 106 of the body 100. The second slit portion S2 may be formed along an edge portion between the second surface 102 of the body 100 and the sixth surface 106 of the body 100. Accordingly, the slit portions S1 and S2 may be configured to extend from the third surface 103 of the body 100 to the fourth surface 104. The slit portions S1 and S2 may not extend to the fifth surface 105 of the body 100. Accordingly, the slit portions S1 and S2 may not penetrate the body 100 in a thickness direction of the body 100.

The slit portions S1 and S2 may be formed by performing a pre-dicing process on one surface of a coil bar along a boundary in a width direction of the coil component among boundaries for dividing the coil bar into coil components in a level of a coil bar, a state before dividing the coil bar into coil components. In the pre-dicing process, a depth may be adjusted to expose lead-out portions 231 and 232 to internal surfaces of the slit portions S1 and S2. Each of the internal surfaces of the slit portions S1 and S2 may have an internal wall substantially parallel to the first and second surfaces 101 and 102 of the body 100 and a lower surface connecting the internal wall to the first and second surfaces 101 and 102 of the body 100. In the description below, each of the slit portions S1 and S2 may have the internal wall and the lower surface, but an example embodiment thereof is not limited thereto. As an example, the internal wall of the first slit portion S1 may be formed such that a cross-sectional surface of the first slit portion S1 may have a curved line shape connecting the first surface 101 of the body 100 to the sixth surface 106 of the body 100.

The internal walls and the lower surfaces of the slit portions S1 and S2 may also form a surface of the body 100. In one embodiment, however, the internal walls and the lower surfaces of the slit portions S1 and S2 may be distinguished from a surface of the body 100 for ease of description.

The coil portion 200 may be embedded in the body 100 and may exhibit properties of a coil component. For example, when the coil component 1000 is used as a power inductor, the coil portion 200 may store an electrical field as a magnetic field and may maintain an output voltage, thereby stabilizing power of an electronic device.

The coil portion 200 may include coil patterns 211 and 212, lead-out portions 231 and 232, auxiliary lead-out portions 241 and 242, and vias 221, 222, and 223.

For example, as illustrated in FIGS. 4 and 5, the first coil pattern 211, the first lead-out portion 231, and the second lead-out portion 232 may be disposed on a lower surface of the support substrate IL opposing the sixth surface 106 of the body 100, and the second coil pattern 212, the first auxiliary lead-out portion 241, and the second auxiliary lead-out portion 242 may be disposed on an upper surface of the support substrate IL opposing the lower surface of the support substrate IL. On a lower surface of the support substrate IL, the first coil pattern 211 may be in contact with and connected to the first lead-out portion 231, and the first coil pattern 211 and the first lead-out portion 231 may be spaced apart from the second lead-out portion 232. On an upper surface of the support substrate IL, the second coil pattern 212 may be in contact with and connected to the second auxiliary lead-out portion 242, and the second coil pattern 212 and the second auxiliary lead-out portion 242 may be spaced apart from the first auxiliary lead-out portion 241. The first via 221 may penetrate the support substrate IL and may be in contact with and connected to each of the first coil pattern 211 and the second coil pattern 212. The second via 222 may penetrate the support substrate IL and be in contact with and connected to each of the first lead-out portion 231 and the first auxiliary lead-out portion 241. The third via 223 may penetrate the support substrate IL and may be in contact with and connected to each of the second lead-out portion 232 and the second auxiliary lead-out portion 242. Accordingly, the coil portion 200 may function as a single coil.

Each of the first coil pattern 211 and the second coil pattern 212 may have a planar spiral shape forming at least one turn with reference to the core 110 of the body 100 as a shaft. As an embodiment, the first coil pattern 211 may form at least one turn with reference to the core 110 as a shaft on a lower surface of the support substrate IL.

The slit portions S1 and S2 may extend to the first lead-out portion 231 and the second lead-out portion 232, respectively. Accordingly, the first lead-out portion 231 may be exposed to each of a lower surface and an internal wall of the first slit portion S1, and the second lead-out portion 232 may be exposed to a lower surface and an internal wall of the second slit portion S2. Accordingly, due to the slit portions S1 and S2, in the lead-out portions 231 and 232, a thickness of a region of each of the lead-out portions 231 and 232 forming the lower surface of each of the slit portions S1 and S2 may be different from a thickness of a region of each of the lead-out portions 231 and 232 forming the internal wall of each of the slit portions S1 and S2. The external electrodes 300 and 400 may be formed in the lead-out portions 231 and 232 exposed to the lower surfaces and the internal walls of the slit portions S1 and S2 such that the coil portion 200 may be connected to the external electrodes 300 and 400.

One surfaces of the lead-out portions 231 and 232 exposed to the internal walls and the lower surfaces of the slit portions S1 and S2 may have surface roughness higher than that of the other surfaces of the lead-out portions 231 and 232. As an example, when the lead-out portions 231 and 232 are formed by an electrolytic plating process and then the slit portions S1 and S2 are formed on the lead-out portions 231 and 232 and the body 100, a portion of each of the lead-out portions 231 and 232 may be removed in a process of forming the slit portions. Accordingly, the one surfaces of the lead-out portions 231 and 232 exposed to the internal walls and the lower surfaces of the slit portions S1 and S2 may have surface roughness higher than that of the other surfaces of the lead-out portions 231 and 232 due to the grinding of a dicing tip. Each of the external electrodes 300 and 400 may be configured as a thin film such that cohesion force with the body 100 may be relatively weak. As the external electrodes 300 and 400 are in contact with and connected to the one surfaces of the lead-out portions 231 and 232 having relatively high roughness, however, cohesion force between the external electrodes 300 and 400 and the lead-out portions 231 and 232 may improve.

The lead-out portions 231 and 232 and the auxiliary lead-out portions 241 and 242 may be exposed to the both end surfaces 101 and 102 of the body 100, respectively. Accordingly, the first lead-out portion 231 may be exposed to the first surface 101 of the body 100, and the second lead-out portion 232 may be exposed to the second surface 102 of the body 100. The first auxiliary lead-out portion 241 may be exposed to the first surface 101 of the body 100, and the second auxiliary lead-out portion 242 may be exposed to the second surface 102 of the body 100. Accordingly, the first lead-out portion 231 may be exposed to the internal wall of the first slit portion S1, the lower surface of the first slit portion S1, and the first surface 101 of the body 100, and the second lead-out portion 232 may be exposed to the internal wall of the second slit portion S2, the lower surface of the second slit portion S2, and the second surface 102 of the body 100.

At least one of the coil patterns 211 and 212, the vias 221, 222, and 223, the lead-out portions 231 and 232, and the auxiliary lead-out portions 241 and 242 may include at least one or more conductive layers.

As an example, when the second coil pattern 212, the auxiliary lead-out portions 241 and 242, and the vias 221, 222, and 223 are formed on the other surface of the support substrate IL by a plating process, each of the second coil pattern 212, the auxiliary lead-out portions 241 and 242, and the vias 221, 222, and 223 may include a seed layer such as an electroless plating layer and an electrolytic plating layer. The electrolytic plating layer may have a single layer structure or a multilayer structure. The electrolytic plating layer having a multilayer structure may be formed in conformal film structure in which an electroplating layer is covered by another electroplating layer, or a structure in which an electroplating layer is only layered on one surface of one of the electroplating layers. A seed layer of the second coil pattern 212, a seed layer of the auxiliary lead-out patterns 241 and 242, and a seed layer of the vias 221, 222, and 223 may be integrated with one another such that a boundary may not be formed among the elements, but an example embodiment thereof is not limited thereto. An electroplating layer of the second coil pattern 212, an electroplating layer of the auxiliary lead-out patterns 241 and 242 and an electroplating layer of the vias 221, 222, and 223 may be integrated with one another such that a boundary may not be formed among the elements, but an example embodiment thereof is not limited thereto.

As another example, as illustrated in FIGS. 4 and 5, when the coil portion 200 is formed by separately forming the first coil pattern 211 and the lead-out portions 231 and 232 disposed on the lower surface of the support substrate IL and the second coil pattern 212 and the auxiliary lead-out portions 241 and 242 disposed on the upper surface of the support substrate IL, and collectively layering the above-mentioned elements on the support substrate IL, the vias 221, 222, and 223 may include a metal layer having a high melting point and a metal layer having a low melting point lower than a melting point of a metal layer having a high melting point. The metal layer having a low melting point may be formed of solder including lead (Pb) and/or tin (Sn). The metal layer having a low melting point may be partially melted due to pressure and temperature when the metal layers having a low melting point are collectively layered, and accordingly, an intermetallic compound layer (IMC layer) may be formed between the metal layer having a low melting point and the second coil pattern 212, for example.

The coil patterns 211 and 212, the lead-out portions 231 and 232, and the auxiliary lead-out portions 241 and 242 may be protrude onto the lower surface and the upper surface of the support substrate IL as illustrated in FIGS. 4 and 5, for example. As another embodiment, the coil patterns 211 and 212 and the lead-out portions 231 and 232 may protrude onto the lower surface of the support substrate IL, and the second coil pattern 212 and the auxiliary lead-out portions 241 and 242 may be embedded in the upper surface of the support substrate IL such that upper surfaces thereof may be exposed to the upper surface of the support substrate IL. In this case, a recessed portion may be formed on at least one of the upper surface of the second coil pattern 212 and the upper surfaces of the auxiliary lead-out portions 241 and 242 such that the upper surface of the support substrate IL and the upper surface of the second coil pattern 212 and/or the upper surfaces of the auxiliary lead-out portions 241 and 242 may not be disposed on the same plane.

Each of the coil patterns 211 and 212, the lead-out portions 231 and 232, the auxiliary lead-out portions 241 and 242, and the vias 221, 222, and 223 may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto.

As the first auxiliary lead-out pattern 241 is not relevant to electrical connection between the other elements of the coil portion 200, the first auxiliary lead-out pattern 241 may not be provided in example embodiments. In this case, a volume of a magnetic material in the body 100 may increase by a volume corresponding to the first auxiliary lead-out pattern 241. However, to omit the process of distinguishing the fifth surface 105 and the sixth surface 106 of the body 100, the first auxiliary lead-out pattern 241 may be formed as illustrated in FIGS. 1 to 6.

The plating prevention portions R1 and R2 may be embedded in the lead-out portions 231 and 232, respectively, and having one surfaces exposed to internal surfaces of the slit portions S1 and S2. For example, the first plating prevention portion R1 may be embedded in the first lead-out portion 231 and one surface of the first plating prevention portion R1 may be exposed to a lower surface of the first slit portion S1, and the second plating prevention portion R2 may be embedded in the second lead-out portion 232 and one surface of the second plating prevention portion R2 may be exposed to a lower surface of the second slit portion S2.

The plating prevention portions R1 and R2 may be disposed on boundaries between the lower surfaces of the slit portions S1 and S2 and the first and second surfaces 101 and 102 of the body 100. Accordingly, one surfaces of the plating prevention portions R1 and R2 may be exposed to the lower surfaces of the slit portions S1 and S2, and the other surface connected to the one surface may be exposed to the first and second surfaces 101 and 102 of the body 100. The other surfaces of the plating prevention portions R1 and R2 may be disposed on planes the same as the first and second surfaces 101 and 102 of the body 100, respectively.

In an embodiment, the one surfaces of the plating prevention portions R1 and R2 may not extend to the internal wall of the slit portions S1 and S2 such that at least portions of the lead-out portions 231 and 232 are exposed to the lower surfaces of the slit portions S1 and S2, respectively. Accordingly, as illustrated in FIG. 6, each of the lead-out portions 231 and 232 may include a first region in which the plating prevention portions R1 and R2 are inserted, a second region forming the lower surfaces of the slit portions S1 and S2, and a third region forming the internal walls of the slit portions S1 and S2. The second region may have a thickness greater than a thickness of the first region and less than a thickness of the third region.

The plating prevention portions R1 and R2 may include an insulating resin, the plating prevention portions R1 and R2 may also include a filler dispersed in an insulating resin. The insulating resin may be a thermosetting resin such as epoxy, but an example embodiment thereof is not limited thereto. To be bonded to the body 100, the insulating resin included in the plating prevention portions R1 and R2 and the insulating resin included in the body 100 may be the same material or may have the same physical properties.

Due to a structure, a position, and a material of the plating prevention portions R1 and R2, the plating prevention portions R1 and R2 may prevent the external electrodes 300 and 400 from extending to the first and second surfaces 101 and 102 of the body 100. Accordingly, the external electrodes 300 and 400 may be formed on surfaces of the lead-out portions 231 and 232 exposed to the internal walls and the lower surfaces of the slit portions S1 and S2 through a plating process, and as the plating prevention portions R1 and R2 formed of an insulating material may be disposed on boundary regions between the lower surfaces of the slit portions S1 and S2 and the first and second surfaces 101 and 102 of the body 100, the external electrodes 300 and 400 may not extend to the first and second surfaces 101 and 102 of the body 100. Portions of the external electrodes 300 and 400 may extend to one surfaces of the plating prevention portions R1 and R2 exposed to the lower surfaces of the slit portions S1 and S2. In this case, the external electrodes 300 and 400 may prevent boundaries between the plating prevention portions R1 and R2 and the lead-out portions 231 and 232 from being externally exposed.

The plating prevention portions R1 and R2 may extend from the third surface 103 of the body 100 to the fourth surface 104. Accordingly, the plating prevention portions R1 and R2 may be inserted into the lead-out portions 231 and 232 and the body 100 in a form of a bar formed in the width direction W of the body 100. When the body 100 includes a metal magnetic powder, the metal magnetic powder may be exposed to internal surfaces of the slit portions S1 and S2, and in this case, when the external electrodes 300 and 400 are formed by a plating process, the external electrodes 300 and 400 may be plated and grown on the internal surfaces of the slit portions S1 and S2. Thus, by disposing the plating prevention portions R1 and R2 on the overall boundary areas between the lower surfaces of the slit portions S1 and S2 and the first and second surfaces 101 and 102 of the body 100, the external electrodes 300 and 400 may be prevented from extending to the first and second surfaces 101 and 102 of the body 100.

The plating prevention portions R1 and R2 and the slit portions S1 and S2 may be formed in a state of a coil bar, a state before dividing the coil bar into a plurality of individual components. As an example, a primary slit formed by performing a primary pre-dicing process for forming the plating prevention portions R1 and R2 may be filled with an insulating material for forming the plating prevention portions R1 and R2, and a secondary pre-dicing process may be performed to form the slit portions S1 and S2. Thereafter, the coil bar may be divided into a plurality of individual components through a full-dicing process such that the plating prevention portions R1 and R2 and the slit portions S1 and S2 are formed in each component. A width of a dicing tip of the primary pre-dicing process may be less than a width of a dicing tip of the secondary pre-dicing process, and may be greater than a width of a dicing tip of the full dicing process. Also, a dicing depth of the primary pre-dicing process may be greater than a dicing depth of the secondary pre-dicing process.

The external electrodes 300 and 400 may be connected to the coil portion 200, may be disposed on the sixth surface 106 of the body 100 and may be spaced apart from each other. For example, the first external electrode 300 may be connected to the first lead-out portion 231. The second external electrode 400 may be connected to the second lead-out portion 232. The first external electrode 300 and the second external electrode 400 may be spaced apart from each other on the sixth surface 106 of the body 100.

The external electrodes 300 and 400 may be formed along the internal walls of the slit portions S1 and S2 and the sixth surface 106 of the body 100, respectively. The external electrodes 300 and 400 may be formed on the internal walls of the slit portions S1 and S2 and the sixth surface 106 of the body 100 in a form of a conformal film. The external electrodes 300 and 400 may be integrated on the internal walls of the slit portions S1 and S2 and the sixth surface 106 of the body 100. To this end, the external electrodes 300 and 400 may be formed by a sputtering process or a thin film process such as a plating process.

The external electrodes 300 and 400 may be formed of a conductive material such as copper (Cu), aluminum (Al), silver (Ag), tin (Sn), gold (Au), nickel (Ni), lead (Pb), titanium (Ti), or alloys thereof, but an example of the material is not limited thereto. The external electrodes 300 and 400 may have a single layer or a plurality of layers. As an example, the external electrodes 300 and 400 may be in contact with and formed on the lower surfaces of the slit portions S1 and S2, the internal walls of the slit portions S1 and S2, and the sixth surface 106 of the body 100, respectively, and may include a first layer formed of copper (Cu), a second layer disposed on the first layer and formed of nickel (Ni), and a third layer disposed on the second layer and formed of tin (Sn), but an example embodiment thereof is not limited thereto.

The external electrodes 300 and 400 may extend to the lower surfaces of the slit portions S1 and S2, respectively. In this case, a contact area between the external electrodes 300 and 400 and the lead-out portions 231 and 232 may increase such that cohesion force between the external electrodes 300 and 400 and the lead-out portions 231 and 232 may improve.

Although not illustrated in the diagram, the coil component 1000 in one embodiment may include an insulating film formed along the lead-out portions 231 and 232, the coil patterns 211 and 212, the support substrate IL, and the auxiliary lead-out portions 241 and 242. The insulating film may protect the lead-out portions 231 and 232, the coil patterns 211 and 212, and the auxiliary lead-out portions 241 and 242 and may insulate the lead-out portions 231 and 232, the coil patterns 211 and 212, and the auxiliary lead-out portions 241 and 242 from the body, and may include a generally used insulating material such as parylene. The insulating material included in the insulating film may be implemented by any insulating material, and the insulating film may be formed by a vapor deposition method, but an example embodiment thereof is not limited thereto. The insulating film may be formed by layering a insulating film on both surfaces of the support substrate IL.

The surface insulating layer 500 may be disposed on a surface of the body 100 and may expose the internal surfaces of the slit portions S1 and S2. Accordingly, the surface insulating layer 500 may expose a portion of the sixth surface 106 of the body 100 on which the external electrodes 300 and 400 are disposed among the first to sixth surfaces 101, 102, 103, 104, 105, and 106 of the body 100. The surface insulating layer 500 may be formed by a vapor deposition method, a spraying coating method, a film layering method, or the like, but an example embodiment thereof is not limited thereto. The surface insulating layer 500 may include a thermoplastic resin such as polystyrene resin, vinyl acetate resin, polyester resin, polyethylene resin, polypropylene resin, polyamide resin, rubber resin, acrylic resin, or the like, a thermosetting resin such as phenol resin, epoxy resin, urethane resin, melamine resin, alkyd resin, a photosensitive resin, parylene, SiOx, or SiNx. The surface insulating layer 500 may be formed on the body 100 before a process of forming the external electrodes 300 and 400 and may function as a plating resist when the external electrodes 300 and 400 are formed by a plating process. The surface insulating layer 500 may be formed in an integrated manner, or the surface insulating layer 500 may be formed by a plurality of processes such that a boundary may be formed between the surface insulating layer 500 formed on a portion of a surface of the body 100 and the surface insulating layer 500 formed on the other region.

In one exemplary embodiment, the first and second external electrodes 300 and 400 may at least partially overlap, and may be in contact with, the first and second plating prevention portions R1 and R2, respectively, in the thickness direction.

In one exemplary embodiment, the first lead-out portion 231 may include a first groove along a corner edge thereof between an exposed surface of the first lead-out portion 231 in the length direction and a bottom surface thereof opposing one surface of the support substrate IL on which the first lead-out portion 231 is disposed in the thickness direction. The second lead-out portion 232 may include a second groove along a corner edge thereof between an exposed surface of the second lead-out portion 232 in the length direction and one surface thereof opposing the one surface of the support substrate IL in the thickness direction.

In one exemplary embodiment, each of the first and second lead-out portions 231 and 232 may include a first reduced-thickness portion and a second reduced-thickness portion, extending in the length direction from the respective exposed surface of the first and second lead-out portions 231 and 232, and a reduced-thickness of the second reduced-thickness portion from the respective exposed surface may be larger than a reduced-thickness of the first reduced-thickness portion from the respective exposed surface.

In one exemplary embodiment, the first and second plating prevention portions R1 and R2 may partially penetrate the first and second lead-out portions 231 and 232, respectively, with respect to innermost portions of the first and second slit portions S1 and S2 in the length direction, such that the first and second plating prevention portions R1 and R2 are spaced apart from the innermost portions of the first and second slit portions S1 and S2, respectively, in the length direction. Accordingly, the coil component 1000 in one embodiment may have a reduced size and may easily implement a lower electrode structure. Thus, differently from a general coil component, an external electrode may not protrude from the both end surfaces 101 and 102 or the both side surfaces 103 and 104 of the body 100 such that an overall length and a width of the coil component 1000 may not increase. Also, as the external electrodes 300 and 400 are formed by a thin film process, each of the external electrodes 300 and 400 may have a reduced thickness such that an overall thickness of the coil component 1000 may be reduced. Further, a contact area between the external electrodes 300 and 400 and the lead-out portions 231 and 232 may increase by the slit portions S1 and S2 formed on the body 100 such that component reliability may improve. Also, by including the plating prevention portions R1 and R2, the extension of the external electrodes 300 and 400 to the first and second surfaces 101 and 102 of the body 100, which may be caused by the spreading of the plating material, may be prevented. Accordingly, when the coil component in one embodiment 1000 is mounted on a mounting substrate, electrical shorts with the other electronic components adjacently mounted may be prevented.

Second Embodiment

Figure 7:
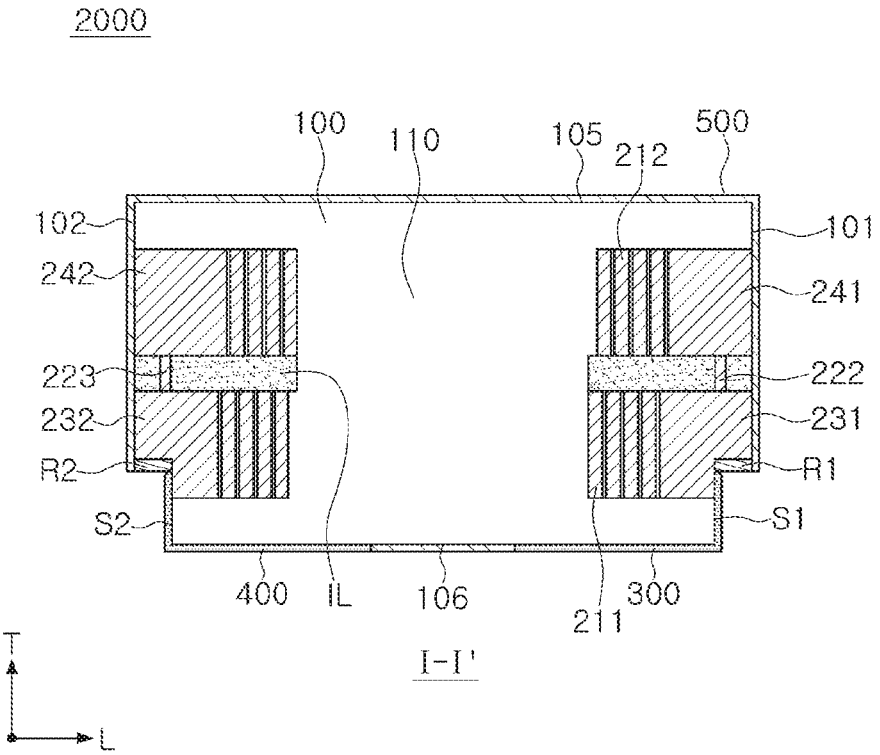
FIG. 7 is a diagram illustrating a coil component according to a second embodiment, corresponding to the cross-sectional diagram taken along line I-I' in FIG. 1.

FIG. 7 is a diagram illustrating a coil component according to a second embodiment, corresponding to the cross-sectional diagram taken along line I-I' in FIG. 1.

Referring to FIGS. 1 to 6 and FIG. 7, in a coil component 2000 in one embodiment, shapes of the plating prevention portions R1 and R2 and shapes of the lead-out portions 231 and 232 may be different from those of the coil component 1000 described in the first embodiment. Accordingly, in one embodiment, only the shapes of the plating prevention portions R1 and R2 and the lead-out portions 231 and 232, different from the aforementioned embodiment, will be described. The descriptions of the other elements may be the same as in the first embodiment.

As for the plating prevention portions R1 and R2 applied in one embodiment, one surfaces of the plating prevention portions R1 and R2 may extend to the internal walls of the slit portions S1 and S2, differently from the first embodiment. Also, the lead-out portions 231 and 232 may be exposed to the internal walls of the slit portions S1 and S2, respectively. Accordingly, the external electrodes 300 and 400 may be in contact with and connected to the lead-out portions 231 and 232 only in the internal walls of the slit portions S1 and S2.

That is because, in one embodiment, when the primary pre-dicing process and the secondary pre-dicing process described above are performed, a width of a dicing tip of the primary pre-dicing process and a dicing tip of the secondary pre-dicing process may be the same.

The external electrodes 300 and 400 in one embodiment may allow overall lower surfaces of the slit portions S1 and S2 to be configured as one surfaces of the plating prevention portions R1 and R2. Accordingly, the external electrodes 300 and 400 may be prevented from extending to the first and second surfaces 101 and 102 of the body 100. Also, as the primary pre-dicing process and the secondary pre-dicing process described above are performed using the same dicing tip, manufacturing costs and time may be reduced.

In one embodiment, the first and second plating prevention portions R1 and R2 may entirely penetrate the first and second lead-out portions 231 and 232, respectively, with respect to innermost portions of the first and second slit portions S1 and S2 in the length direction, such that innermost ends of the first and second plating prevention portions R1 and R2 are disposed on the same planes as the innermost portions of the first and second slit portions S1 and S2 in the length direction, respectively.

According to the aforementioned embodiments, the coil component may have a reduced size.

Also, a lower surface electrode structure may be easily formed.

While the exemplary embodiments have been shown and described above, it will be apparent to those skilled in the art that modifications and variations could be made without departing from the scope of the present invention as defined by the appended claims.

What is claimed is:

1. A coil component, comprising:

a body having a first surface and a second surface opposing each other, and a plurality of walls connecting the first surface to the second surface, the plurality of walls including both end surfaces opposing each other;

a support substrate embedded in the body;

a coil portion including first and second lead-out portions disposed on one surface of the support substrate facing the first surface of the body, the first and second lead-out portions being spaced apart from each other;

slit portions formed along edge portions between the both end surfaces and the first surface of the body, respectively, wherein the first and second lead-out portions are exposed to internal surfaces of the slit portions, respectively;

plating prevention portions embedded in the first and second lead-out portions, respectively, and having first surfaces exposed to the internal surfaces of the slit portions, respectively; and first and second external electrodes disposed on the first surface of the body, spaced apart from each other, extending to the internal surfaces of the slit portions, respectively, and connected to the first and second lead-out portions, respectively.

2. The coil component of claim 1, wherein the plating prevention portions respectively extend to both side surfaces of the body connecting the both end surfaces of the body to each other among the plurality of walls of the body.

3. The coil component of claim 1, wherein the plating prevention portions are disposed on boundaries between the internal surfaces of the slit portions and the both end surfaces of the body, respectively.

4. The coil component of claim 3, wherein second surfaces of the plating prevention portions, respectively connected to the first surfaces of the plating prevention portions and respectively exposed to the both end surfaces of the body, are disposed on the same planes as the both end surfaces of the body, respectively.

5. The coil component of claim 1, wherein the internal surfaces of the slit portions respectively have internal walls substantially parallel to the both end surfaces of the body, and lower surfaces respectively connecting the internal walls to the both end surfaces of the body, and wherein the first surfaces of the plating prevention portions are exposed to the lower surfaces of the slit portions.

6. The coil component of claim 5, wherein the first surfaces of the plating prevention portions are spaced apart from the internal walls of the slit portions, respectively, such that at least portions of the first and second lead-out portions are exposed to the lower surfaces of the slit portions, respectively.

7. The coil component of claim 6, wherein the first and second external electrodes extend to the first and second lead-out portions exposed to the lower surfaces of the slit portions, respectively.

8. The coil component of claim 7, wherein at least portions of the first and second external electrodes further extend along the first surfaces of the plating prevention portions, respectively.

9. The coil component of claim 5, wherein the plating prevention portions respectively extend to the internal walls of the slit portions, and wherein the first and second lead-out portions are exposed only to the internal walls of the slit portions, respectively.

10. The coil component of claim 1, wherein each of the plating prevention portions includes an insulating resin and a filler.

11. The coil component of claim 1, wherein each of the first and second external electrodes includes a plurality of layers, and wherein each of the plurality of layers includes a metal.

12. The coil component of claim 1, further comprising a surface insulating layer disposed on a surface of the body and configured to expose the internal surfaces of the slit portions.

13. A coil component, comprising:

a body having a first surface and a second surface opposing each other in a thickness direction of the body, and a plurality of walls connecting the first surface to the second surface, the plurality of walls including both end surfaces opposing each other in a length direction of the body;

a support substrate embedded in the body;

a coil portion including first and second lead-out portions disposed on one surface of the support substrate facing the first surface of the body in the thickness direction, the first and second lead-out portions being spaced apart from each other and exposed to the both end surfaces in the length direction;

first and second external electrodes disposed on the first surface of the body, spaced apart from each other, and connected to the first and second lead-out portions, respectively; and first and second plating prevention portions embedded in the first and second lead-out portions, respectively, wherein:

the body includes first and second slit portions along edge portions between the both end surfaces and the first surface of the body, respectively, the first and second plating prevention portions extend along the first and second slit portions, respectively, in the length direction, the first and second external electrodes extend along the first and second slit portions, respectively, in the thickness direction, and the first and second external electrodes at least partially overlap, and are in contact with, the first and second plating prevention portions, respectively, in the thickness direction.

14. The coil component of claim 13, wherein:

the first lead-out portion includes a first groove along a corner edge thereof between an exposed surface of the first lead-out portion in the length direction and one surface thereof opposing the one surface of the support substrate in the thickness direction, and the second lead-out portion includes a second groove along a corner edge thereof between an exposed surface of the second lead-out portion in the length direction and one surface thereof opposing the one surface of the support substrate in the thickness direction.

15. The coil component of claim 13, wherein:

each of the first and second lead-out portions includes a first reduced-thickness portion and a second reduced-thickness portion, extending in the length direction from the respective exposed surface of the first and second lead-out portions, and a reduced-thickness of the second reduced-thickness portion from the respective exposed surface is larger than a reduced-thickness of the first reduced-thickness portion from the respective exposed surface.

16. The coil component of claim 13, wherein the first and second plating prevention portions partially penetrate the first and second lead-out portions, respectively, with respect to innermost portions of the first and second slit portions in the length direction, such that the first and second plating prevention portions are spaced apart from the innermost portions of the first and second slit portions, respectively, in the length direction.

17. The coil component of claim 16, wherein the first and second external electrodes are bent and further extend along the first and second slit portions, respectively, in the length direction to be connected to the first and second plating prevention portions, respectively.

18. The coil component of claim 13, wherein the first and second plating prevention portions entirely penetrate the first and second lead-out portions, respectively, with respect to innermost portions of the first and second slit portions in the length direction, such that innermost ends of the first and second plating prevention portions are disposed on the same planes as the innermost portions of the first and second slit portions in the length direction, respectively.

19. The coil component of claim 13, wherein each of the first and second external electrodes includes a plurality of layers, and wherein each of the plurality of layers includes a metal.

20. The coil component of claim 13, further comprising a surface insulating layer disposed on the second surface of the body and extending onto the both end surfaces of the body, wherein the surface insulating layer is in contact with the first and second plating prevention portions.

* * * * *